US010137701B2

(12) United States Patent
Thijssen et al.

(10) Patent No.: US 10,137,701 B2
(45) Date of Patent: Nov. 27, 2018

(54) DUPLEX PRINTING SYSTEM FOR CUT SHEETS AND A METHOD THEREFORE

(71) Applicant: Océ Holding B.V., Venlo (NL)

(72) Inventors: Abraham Thijssen, Venlo (NL); Henricus J. A. Van De Sande, Venlo (NL); Rob Hoogendijk, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/587,595

(22) Filed: May 5, 2017

(65) Prior Publication Data

US 2017/0326889 A1 Nov. 16, 2017

(30) Foreign Application Priority Data

May 13, 2016 (EP) ..... 16169551

(51) Int. Cl.
*B41J 3/60* (2006.01)
*B41J 2/165* (2006.01)
*B41J 13/00* (2006.01)

(52) U.S. Cl.
CPC ..... *B41J 3/60* (2013.01); *B41J 2/16526* (2013.01); *B41J 13/0027* (2013.01); *B41J 2002/16573* (2013.01)

(58) Field of Classification Search
CPC ..... B41J 3/60; B41J 2/16526; B41J 13/0027; B41J 2002/16573
See application file for complete search history.

(56) References Cited

U.S. PATENT DOCUMENTS 5,937,261 A * 8/1999 Shirakawa ..... G03G 15/231 271/176
2007/0053711 A1* 3/2007 Litwiller ..... G03G 15/234 399/82
2007/0235925 A1* 10/2007 Johnston ..... G03G 15/234 271/301
2013/0033536 A1* 2/2013 Sawase ..... B41J 2/16526 347/14
2014/0037301 A1 2/2014 Tanaka
2016/0062710 A1 3/2016 Thijssen et al.

FOREIGN PATENT DOCUMENTS

WO WO 2015/132286 A1 9/2015

* cited by examiner

*Primary Examiner* — Yaovi M Ameh
(74) *Attorney, Agent, or Firm* — Birch, Stewart, Kolasch & Birch, LLP

(57) ABSTRACT

The present invention relates to a printing system for cut sheets. The printing system comprises a control unit for controlling the printing of image data on a plurality of sheets which comprise at least one speciality sheet intended to be one-sided printed and at least one duplex sheet intended to be two-sided printed. The control unit schedules the plurality of sheets in a printing order. A paper path of the printing system comprises a duplex printing loop, a first turn station arranged in the duplex printing loop for turning a sheet of the plurality if both sides of the sheet are scheduled to be printed in two passes along a print engine arranged in the duplex printing loop and configured to dispose marking material on the sheets according to the image data, in two passes, one side per pass, and a second turn station arranged in an output section for turning the sheet before laying the sheet off in an output holder of the output section. Speciality sheets and simplex sheets in a duplex print job are treated in a special way to avoid productivity loss.

11 Claims, 4 Drawing Sheets

DUPLEX PRINTING SYSTEM FOR CUT SHEETS AND A METHOD THEREFORE

FIELD OF THE INVENTION

The present invention relates to a printing system for cut sheets, the printing system comprising a control unit for controlling the printing of image data on a plurality of sheets comprising at least one speciality sheet intended to be one-sided printed and at least one duplex sheet intended to be two-sided printed, and for scheduling the plurality of sheets in a printing order, a paper path comprising a duplex printing loop, a first turn station arranged in the duplex printing loop for turning a sheet of the plurality if both sides of the sheet are scheduled to be printed in two passes along a print engine arranged in the duplex printing loop and configured to dispose marking material on the sheets according to the image data on one side per pass, wherein the speciality sheet has predetermined unexchangeable opposite edges, the control unit comprises a scheduler to schedule a sheet for a first pass along the print engine and for a second pass along the print engine by using the duplex printing loop and a logic module to determine whether or not the sheet is a speciality sheet.

BACKGROUND OF THE INVENTION

A simplex sheet is a sheet intended to be printed on one side. A duplex sheet is a sheet intended to be printed on both sides. In most cases a speciality sheet is meant to be printed on one side only, however a speciality sheet may be a duplex sheet.

A mixed-plex print job is a print job that comprises simplex sheets as well as duplex sheets.

A normal sheet is defined as a non-speciality sheet, for which the front side can be processed in the same way as the back side.

Turn stations as such are assumed to be known from the prior art and are therefore not elaborated upon.

According to the paper path of a printing system each of the plurality of sheets is transported from an input section of the printing system towards a print engine comprising a print head or a print assembly. By means of the print head or print assembly marking material is disposed on each of the plurality of sheets. The marking material may be ink which has to be dried or to be UV-cured, or a toner which has to be fused to the sheets. Each of the plurality of sheets is guided from the print head or print assembly towards an output section comprising at least one output holder. In order to enable duplex printing the paper path contains a loop, a so-called duplex loop. A sheet enters the loop in a first pass in order to print image data on one side of the sheet, goes through the duplex loop and enters the duplex loop in a second pass in order to print image data on the other side of the sheet. Therefore the duplex loop comprises a first turn station to turn the sheets that need to be printed on the back side of the sheet.

After a sheet has been printed upon on both sides, the sheet is transported to the output section for further finishing. A print engine with a duplex loop may have a print speed of twice as high as a speed of a separation in the input module and a working speed of an output module or finisher. In such a case the duplex loop may be used to print on the plurality of sheets by interweaving the plurality of sheets in the first pass and in the second pass. The present invention is also applicable in a print mode wherein a plurality of sheets is firstly printed on one side in the first pass, and secondly the plurality is printed on the second side in the second pass, also known as a burst print mode. Duplex sheets that need to be printed on the back side of the sheet are turned by the first turn station, for example in a feed direction of the sheet such that a trailing edge of a sheet in the paper path becomes a leading edge of the sheet in the paper path. The first turn station may be configured to turn the sheet in a direction perpendicular to the feed direction. Sheets that are one-sided printed in the first pass may be interweaved with sheets that need to be printed on the front side in the duplex loop just before the print engine.

Sheets are handled in the order as the sheets are also deposited in the output holder.

The logic module in the control unit may use information about the sheets derived from the print job properties per page of the print job, knowledge of the type of sheets provided in the input holders, and/or input from sensors positioned in the input holders and/or in the paper path which are able to sense the type of sheets. A print job property may be a print medium type property and additional information about the print medium type may be retrieved from a media database available in memory of the control unit.

In the printing system according to the present invention, speciality sheets may be printed upon only on one side due to paper path constraints or due to media constraints. For example, a tab sheet may not be turned in the feeding or transport direction because an extending tab of the tab sheet needs to be kept on the trailing edge because of runability and sheet positioning in the paper path. When a duplex job with normal sheets and speciality sheets is scheduled in the scheduler duplex sheets may be printed by means of the duplex loop and the first turn station, but for printing a speciality sheet of the print job the duplex loop has to be emptied, which results in an unproductive system when printing speciality sheets tabs in combination with duplex sheets and keeping a print order.

It is an object of the present invention to provide a printing system that permits printing of duplex sheets in combination with speciality sheets in a productive way.

SUMMARY OF THE INVENTION

In order to achieve this object, according to the present invention the printing system comprises a second turn station arranged in the paper path of the printing system near an inlet of the output section for turning the sheet before laying the sheet off in an output holder of the output section when activated, and the control unit is configured, for a sheet determined not to be a speciality sheet by means of the logic module, to activate the first turn station to turn the sheet after the first pass and before the second pass of the sheet along the print engine, and, for a sheet determined to be a speciality sheet by means of the logic module, to deactivate the first turn station as to behave as a pass-through for the sheet after the first pass and before the second pass of the sheet along the print engine.

A speciality sheet is fed in the first pass through the duplex loop a first time, not turned by the first turn station, and fed along the print engine in the second pass with the side that was already printed. The logic module ensures that a face direction of the speciality sheet in the output holder is the same as the face direction of the other sheets, i.e. the non-speciality sheets. This is achieved by activating or deactivating the first turn station in the duplex loop and activating or deactivating the second turn station for an individual sheet just before deposition of the individual sheet. The print engine is kept as productive as possible, because all sheets are fed through the duplex loop and therefore keep their order.

According to an embodiment the first turn station and the second turn station are arranged to turn a sheet in a feed direction such that a trailing edge of the sheet becomes a leading edge of the sheet. When a turn station is activated it turns the sheet in the feed direction and when the turn station is deactivated it does not turn the sheet but the turn station behaves like a pass-through station for the sheet.

According to an alternative embodiment the first turn station and the second turn station are arranged to turn a sheet in a direction perpendicular to the feed direction of sheets through the paper path such that a left edge of the sheet in the non-feed direction becomes a right edge of the sheet in the direction perpendicular to the feed direction.

According to an embodiment the control unit is configured to schedule a simplex sheet intended to be printed on only one side for the first pass and/or for the second pass along the print engine as if the simplex sheet is a speciality sheet. A simplex sheet is a sheet intended to be printed on one side. A duplex sheet is a sheet intended to be printed on both sides. A simplex sheet may be promoted to a duplex sheet which is in this case intended to be printed on the front side, to be turned in the duplex loop, while the back side is intended to be left blank. However, according to this embodiment the simplex sheet is treated as if it was a speciality sheet. By processing the simplex sheet as a speciality sheet among a plurality of duplex sheets each sheet is fed through the duplex loop and the determined print order is maintained in the output holder. According to this embodiment the simplex sheet is not turned in the duplex loop.

According to an embodiment the print engine comprises an inkjet print head with a plurality of nozzles and the control unit comprises a spitting scheduler for keeping the plurality of nozzles fit, the spitting scheduler configured to prohibit a spitting action during the second pass along the print engine on a side of the simplex sheet which is intended to be printed upon and on a side of a speciality sheet which is intended to be printed upon. A property of a spitting action is usually that the spitting pattern remains invisible for the human eye when once applied to a side of a sheet. By prohibiting that the spitting action is applied twice to the same side of the sheet, the mentioned property is still valid for a simplex sheet and a speciality sheet which are processed according to the present invention.

According to an alternative embodiment the print engine comprises an inkjet print head with a plurality of nozzles and the control unit comprises a spitting scheduler for keeping the plurality of nozzles fit, the spitting scheduler configured to activate a spitting action during the first and the second pass along the print engine on a same side of the simplex sheet which is intended to be printed upon and on a same side of a speciality sheet which is intended to be printed upon. When visibility of the spitting is negligible or not important, spitting actions may be allowed during the first pass as well as during the second pass of the same side of the speciality sheet. Nozzles are kept fit notwithstanding the presence of speciality sheets to be printed on one side.

According to an embodiment the second turn station is part of the output section of the printing system. The second turn station is then arranged directly after the inlet of the output section in order to have a possibility to turn a printed sheet according to the present invention before laying off the printed sheet in the output holder of the output section.

According to an embodiment the control unit is configured, for a sheet determined not to be a speciality sheet by means of the logic module, to activate the second turn station after the second pass of the sheet along the print engine and before the sheet is laid off in the output holder, and, for a sheet determined to be a speciality sheet by means of the logic module, to deactivate the second turn station as to behave as a pass-through for the sheet after the second pass of the sheet along the print engine and before the sheet is laid off in the output holder. A speciality sheet is not turned at all while a normal sheet is turned twice. The face orientation at the output holder is therefore the same for a speciality sheet as for a normal sheet.

According to an embodiment the control unit is configured, for a sheet determined to be a speciality sheet by means of the logic module, to activate the second turn station after the second pass of the sheet along the print engine and before the sheet is laid off in the output holder, and, for a sheet determined not to be a speciality sheet by means of the logic module, to deactivate the second turn station as to behave as a pass-through for the sheet after the second pass of the sheet along the print engine and before the sheet is laid off in the output holder. A speciality sheet is turned once and a normal sheet is also turned once. The face orientation at the output holder is therefore the same for a speciality sheet as for a normal sheet.

The present invention also relates to a method for controlling the printing of image data by means of a printing system on a plurality of cut sheets comprising at least one speciality sheet intended to be one-sided printed and at least one duplex sheet intended to be two-sided printed, and for scheduling the plurality of sheets in a printing order, the printing system comprising a paper path with a duplex printing loop, a first turn station arranged in the duplex printing loop for turning a sheet of the plurality if both sides of the sheet are scheduled to be printed in two passes along a print engine arranged in the duplex printing loop and configured to dispose marking material on the sheets according to the image data on one side per pass, and a second turn station arranged in the paper path of the printing system near an inlet of an output section for turning the sheet before laying the sheet off in an output holder of the output section, wherein the speciality sheet has predetermined unexchangeable opposite edges, and wherein the method comprises the steps of scheduling a sheet for a first pass along the print engine and for a second pass along the print engine by using the duplex printing loop and determining whether or not the sheet is a speciality sheet, for a sheet determined not to be a speciality sheet, activating the first turn station to turn the sheet after the first pass and before the second pass of the sheet along the print engine, and, for a sheet determined to be a speciality sheet, deactivating the first turn station as to behave as a pass-through for the sheet after the first pass and before the second pass of the sheet along the print engine.

The present invention also relates to a software product comprising program code on a non-transitory computer-readable medium, wherein said program code, when loaded into a computer that is connected to the printing system according to the present invention causes the computer to act according to the method according to the present invention.

BRIEF DESCRIPTION OF THE DRAWINGS

Preferred embodiments will now be described in conjunction with the drawings, wherein.

DETAILED DESCRIPTION OF EMBODIMENTS

Figure 1:
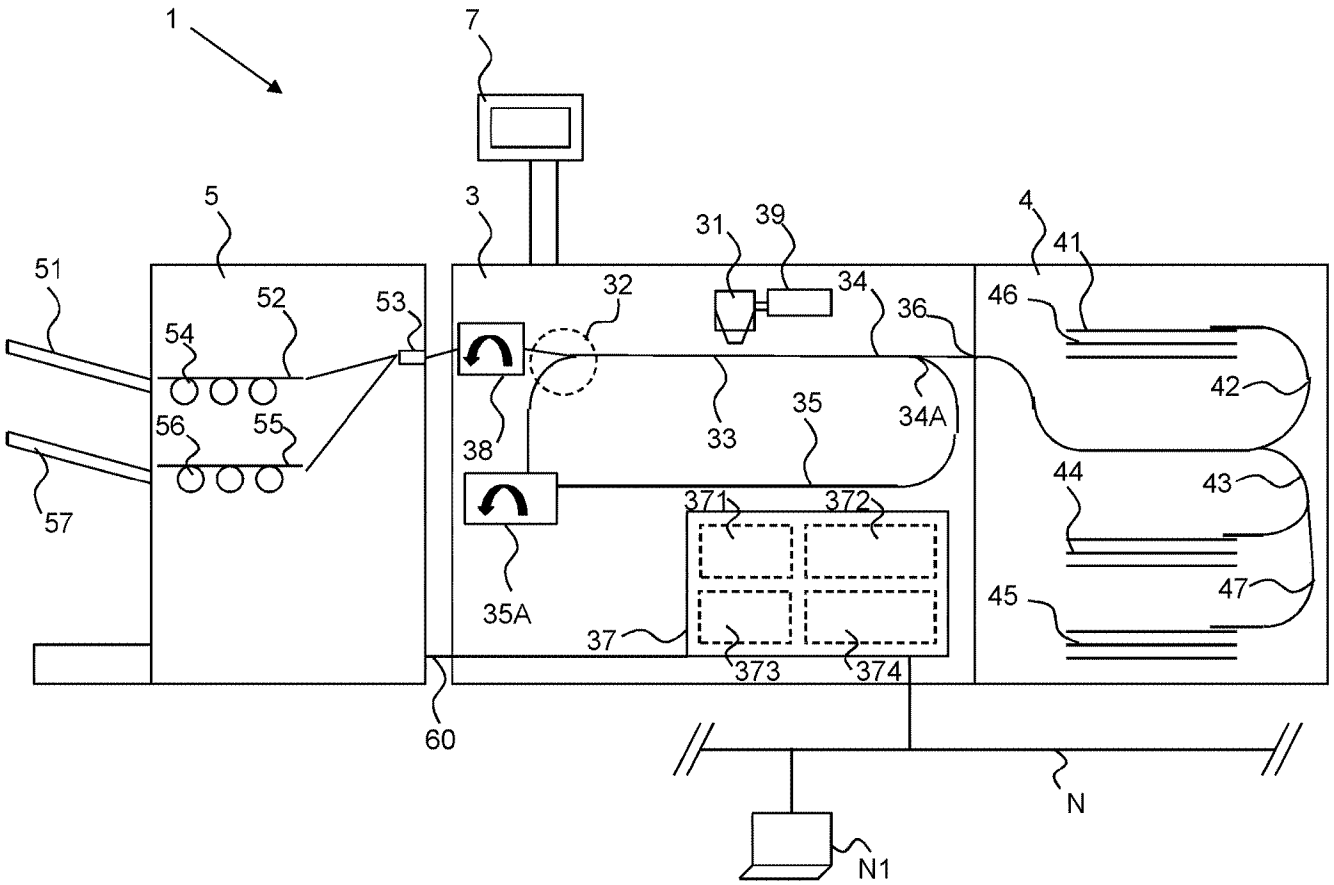
FIG. 1 is a schematic view of a first embodiment of the printing system according to the present invention.

FIG. 1 shows schematically a first embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet printing system, an electrographic printing system, etc.

The output section 5 comprises a first output holder 52 for holding printed image receiving material, for example a plurality of sheets. The output section 5 may comprise a second output holder 55. The printed image receiving material is transported from the print engine and control section 3 via an inlet 53 to one of the output holders 52, 55 in the output section 5. When a stack ejection command is invoked by the control unit 37 for the first output holder 52, first guiding means 54 are activated in order to eject the plurality of sheets in the first output holder 52 outwards to a first external output holder 51. When a stack ejection command is invoked by the control unit 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer and/or data signal control.

The print engine and control section 3 comprises a print engine 31 and a control unit 37 for controlling the printing process and scheduling the plurality of sheets in a printing order before they are separated from input holders 44, 45, 46.

The control unit 37 is a computer, a server or a workstation, connected to the print engine 31 and connected to the digital environment of the printing system 1, for example a network N for transmitting a submitted print job to the printing system 1. In FIG. 1 the control unit 37 is positioned inside the print engine and control section 3, but the control unit 37 may also be at least partially positioned outside the print engine and control section 3 in connection with the network N in a workstation N1.

The control unit 37 comprises a print job receiving section 371 permitting a user to submit a print job to the printing system 1, the print job comprising image data to be printed on a plurality of sheets and a plurality of print job settings. The print job may be a duplex print job for duplex sheets to be printed on both sides of the sheet. The duplex print job may also comprise speciality sheets according to the print job settings, like tab sheets to discern chapters or provide other divisions of a document which is intended to be double-sided printed according to the print job settings.

The control unit 37 comprises a print job queue section 372 comprising a print job queue for print jobs submitted to the printing system 1 and scheduled to be printed.

The control unit 37 comprises a logic module 373 for determining whether or not the sheet is a speciality sheet which need not be turned by a first turn station 35A in the print engine and control section 3 and by the second turn station 38 near the outlet 53 of the output section 5. The logic module 373 unit may use information about the sheets derived from the print job properties per page of the print job, knowledge of the type of sheets provided in the input holders 44, 45, 46, and/or input from sensors (not shown) positioned in the input holders 44, 45, 46 and/or in the paper path which are able to sense the type of sheets. A print job property may be a print medium type property and additional information about the print medium type may be retrieved or derived from a media database available in memory of the control unit 37.

The control unit 37 comprises a sheet scheduling section 374 for determining for each of the plurality of sheets of the print jobs in the print job queue an entrance time in the paper path of the print engine and control section 3, especially an entrance time for the first pass and an entrance time for the second pass in the duplex printing loop in the paper path according to the present invention.

Sheets of media type material are located in the input section 4, marking material is located in a reservoir 39 near or in the print head or print assembly 31 of the print engine, or finishing material may be located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode—like speciality sheets and simplex sheets—and partially in a duplex mode—like duplex sheets. The paper path sections 32, 33, 34, 35 also define the feed direction of the sheets through the paper path of the printing system 1.

The print engine 31 is suitable for disposing marking material to the sheets. The print engine 31 comprises a print head or print assembly which is positioned near the paper path section 34. The print head or print assembly may be an inkjet print head, a direct imaging toner assembly or an indirect imaging toner assembly.

While a sheet is transported along the paper path section 34 in a first pass in the loop, the sheet receives the marking material through the print head or print assembly 31. Directly downstream of the print head or print assembly 31 a rotational functional component may be situated (not shown), for example, a fixation drum, a fixation belt, a fixation device, a drying device, a drying drum, a drying belt, a fusing device, a fusing belt, a fusing drum, a UV curing station, etc. A surface of the rotational functional component is configured to fix the marking material to the sheet or to dry the marking material on the sheet.

A next paper path section 32 is a split unit 32 for selecting a different subsequent paper path for simplex, duplex or mix-duplex printing of the image receiving material.

In case of duplex printing on a sheet, the sheet is transported along the loop via the first turn station 35A in order to turn the sheet for enabling printing on the other side of the sheet. In case of a speciality sheet in a mixed-plex print job as according to the present invention, the sheet is transported along the loop via the first turn station 35A which is deactivated in order to not turn the speciality sheet and to act as a pass-through for the speciality sheet.

The sheet is further transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the duplex loop. The sheets coming from the paper path section 35 are starting their second pass along the print head or print assembly 31 in the duplex loop. When a sheet has passed the print head or print assembly 31 for the second time in the second pass, the sheet is further transported via the split unit 32 to the second turn station 38.

The second turn station 38 may be activated to turn a sheet before the sheet is guided to the inlet 53 of the output section 5.

In a first case (X1) of printing on a speciality sheet or a simplex sheet, the speciality sheet or the simplex sheet is transported via the split unit 32 to the second turn station 38 in order to pass-through the sheet instead of turning the sheet. In this first case the second turn station 38 is deactivated and acts as a pass-through for the speciality sheet to further transport the speciality sheet to the inlet 53 of the output section 5. In this first case the second turn station 38 is activated and turns a normal sheet to further transport the normal sheet to the inlet 53 of the output section 5.

In a second case (X2) of printing on a speciality sheet or a simplex sheet, the speciality sheet or the simplex sheet is transported via the split unit 32 to the second turn station 38 in order to turn the sheet instead of let the sheet pass through. In this case the second turn station 38 is activated and turns speciality sheet to further transport the speciality sheet to the inlet 53 of the output section 5. In this second case the second turn station 38 is deactivated and passes through a normal sheet to further transport the normal sheet to the inlet 53 of the output section 5.

In both the first and the second case the face orientation of the normal sheet and the speciality sheet in the output holder will be the same.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to the entry point 36 for entrance in the print engine and control section 3. Each input holder 44, 45, 46 may be used for holding a different kind of image receiving material, i.e. sheets having different media properties like speciality sheets.

The local user interface 7 is suitable for displaying user interface windows for controlling the print job queue residing in the control unit 37. In another embodiment a computer N1 in the network N has a user interface for displaying and controlling the print job queue of the printing system 1.

Figure 2:
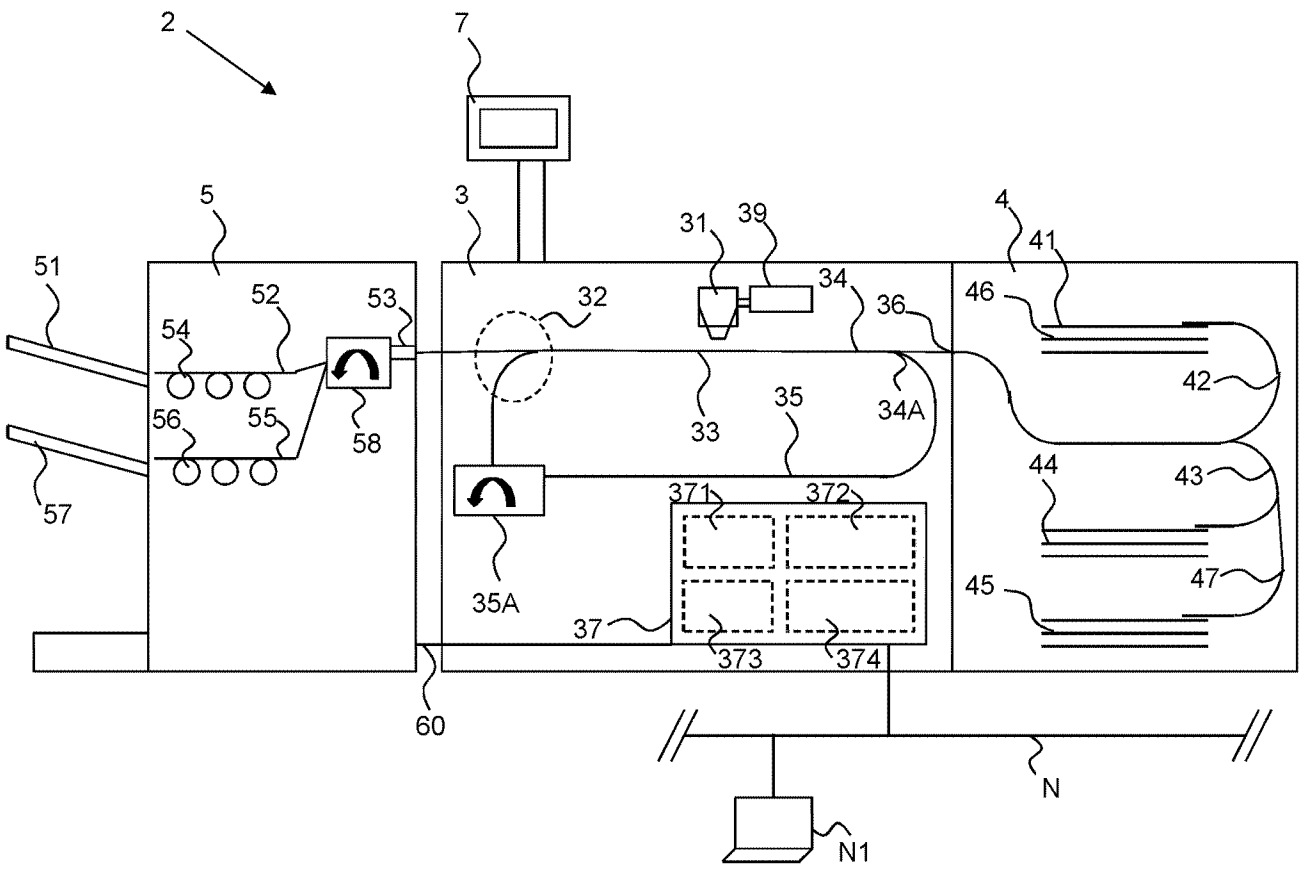
FIG. 2 is a schematic view of a second embodiment of the printing system according to the present invention.

FIG. 2 shows schematically a second embodiment of a printing system 2 according to the present invention. The printing system 2 only differs from the first embodiment in FIG. 1 by the arrangement in the printing system of the second turn station. While in printing system 1 in FIG. 1 the second turn station 38 is arranged in the print engine and control section 3 near the inlet 53 of the output section 5, the second turn station 58 in printing system 2 is arranged in the output section 5 near the inlet 53 of the output section 5.

The first embodiment of the printing system in FIG. 1 and the second embodiment of the printing system in FIG. 2 may be combined into another embodiment having two turn stations in the print engine and control section 3 as well as a turn station in the output section 5 of the printing system. When the output section 5 is an OEM finisher it may have a turn station inside according to a standard implementation of the OEM finisher.

Figure 3:
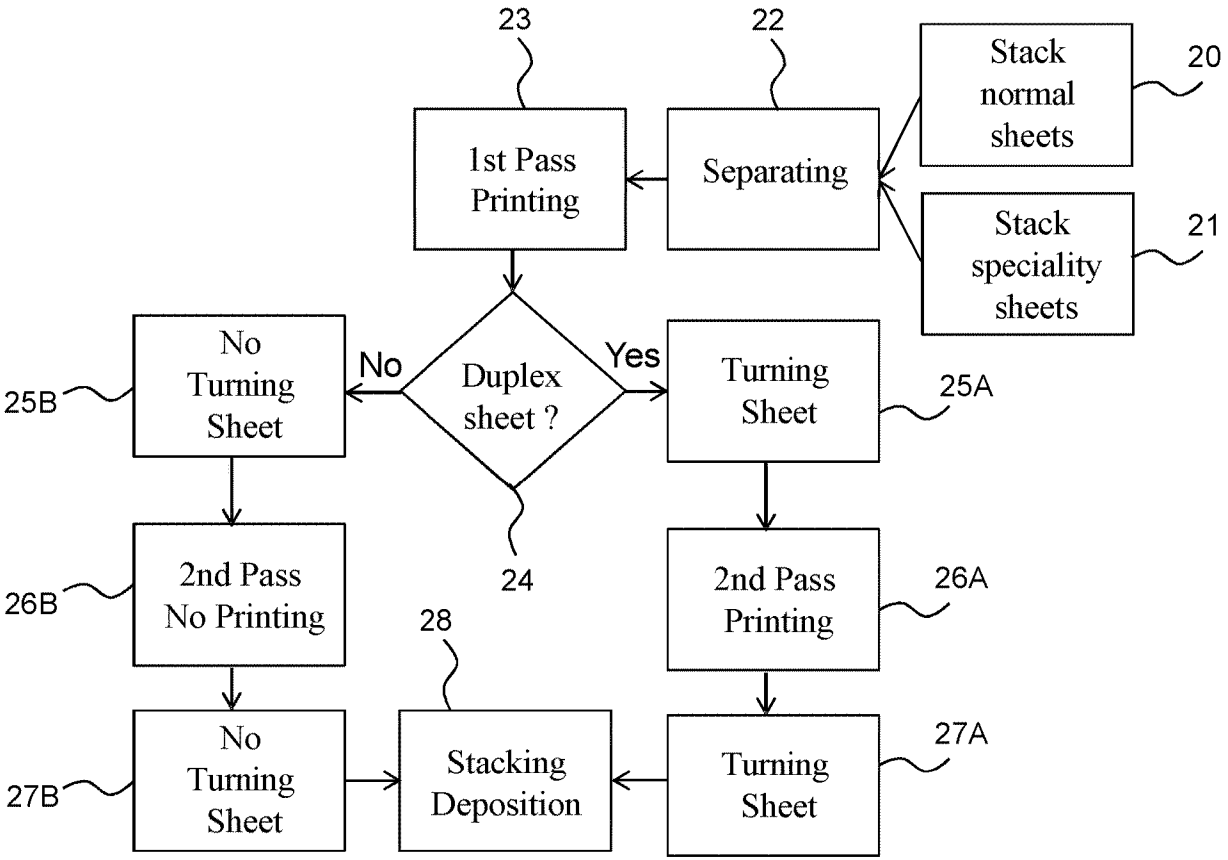
FIG. 3 is a flow diagram of a first embodiment of the method according to the present invention.

FIG. 3 is a schematic view of the steps applied to a sheet guided along the paper path through the printing system 1 of FIG. 1 or the printing system 2 of FIG. 2 according to the first case (X1). A first stack 20 is provided with normal sheets in the input section 4 of the printing system 1,2. A second stack 21 is provided with speciality sheets in the input section 4 of the printing system 1,2. Sheets are separated 22 from the first stack and the second stack according to the printing order as determined by the scheduler of the control unit 37 of the printing system 1,2. The sheets are guided along the print engine for a first pass printing 23. In a next step 24 it is checked if the sheet is a duplex normal sheet, a speciality sheet and/or a normal simplex sheet, by means of the logic module 373.

If the sheet is a duplex normal sheet, the sheet is turned 25A in the first turn station 35A. Then the sheet is printed 26A upon in a second pass along the print engine. When printed on both sides the sheet is turned 27A again in the second turn station 38, 58 and transported to an output holder of the output section 5 and deposited 28—for example face-down—in the output holder.

If the sheet is a speciality sheet and/or a simplex sheet, the sheet is not turned 25B in the first turn station 35A. Then the sheet is guided along the print engine without printing 26B in a second pass. According to an embodiment also a spitting process for keeping nozzles of a print head fit, is halted during this second pass 26B and postponed until after the second pass 26B. According to an alternative embodiment the spitting process for keeping nozzles of a print head fit, is not halted during this second pass 26B and is also applied during the second pass 26B. The sheet is not turned 27B by the second turn station 38, 58 and transported to an output holder of the output section 5 and deposited 28 in the output holder, for example face-down.

Figure 4:
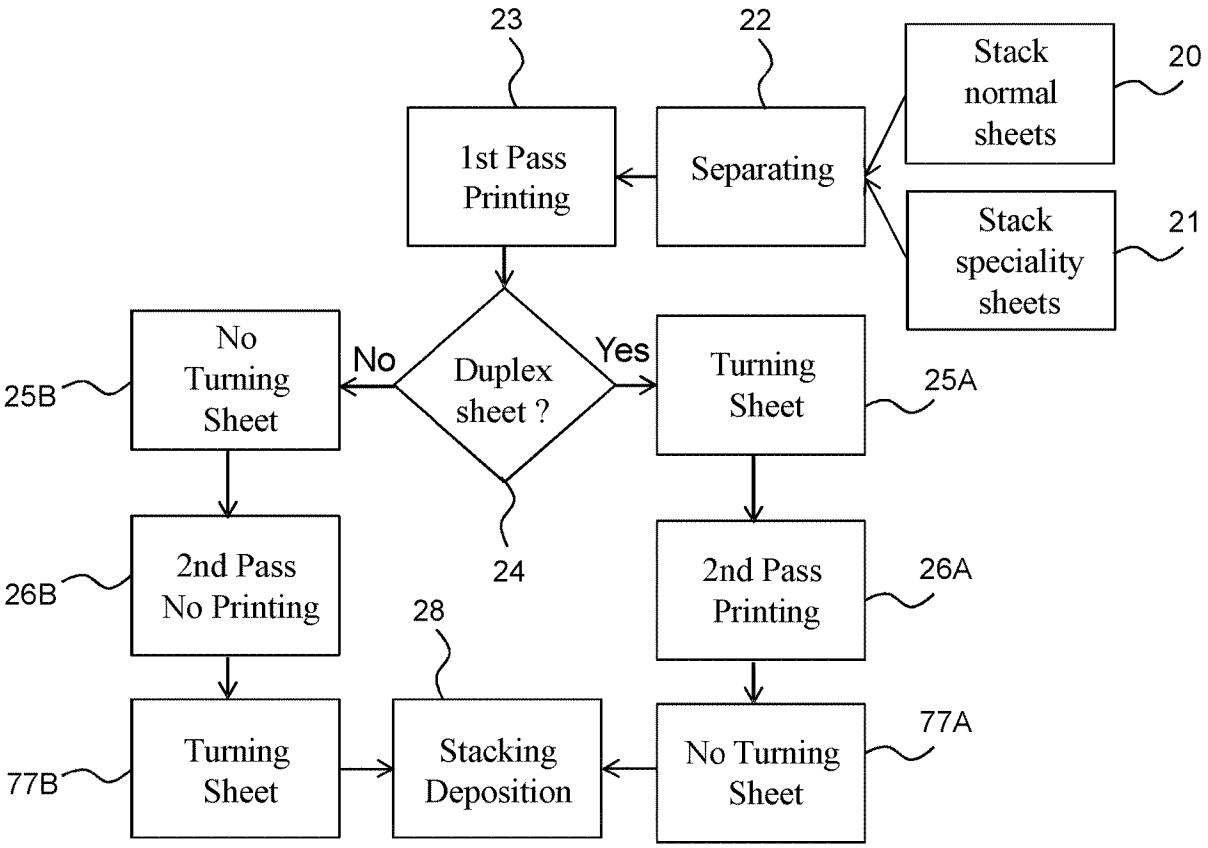
FIG. 4 is a flow diagram of a second embodiment of the method according to the present invention.

FIG. 4 is a schematic view of the steps applied to a sheet guided along the paper path through the printing system 1 of FIG. 1 or the printing system 2 of FIG. 2 according to the second case (X2). The steps resemble the steps of FIG. 3 with the following differences.

If the sheet is a duplex normal sheet, the sheet is turned 25A in the first turn station 35A. Then the sheet is printed 26A upon in a second pass along the print engine. When printed on both sides the sheet is not turned 77A in the second turn station 38, 58 (pass through action) and transported to an output holder of the output section 5 and deposited 28—for example face-down—in the output holder.

If the sheet is a speciality sheet and/or a simplex sheet, the sheet is not turned 25B in the first turn station 35A. Then the sheet is guided along the print engine without printing 26B in a second pass. According to an embodiment also a spitting process for keeping nozzles of a print head fit, is halted during this second pass 26B and postponed until after the second pass 26B. According to an alternative embodiment the spitting process for keeping nozzles of a print head fit, is not halted during this second pass 26B and is also applied during the second pass 26B. The sheet is turned 77B by the second turn station 38, 58 and transported to an output holder of the output section 5 and deposited 28 in the output holder, for example face-down.

In case that the speciality sheet and/or the simplex sheet needs to be printed on the front side of the sheet a selection can be made to print on the sheet during the first pass along the print engine or during the second pass along the print engine.

A speciality sheet may be a tab sheet, a pre-printed sheet, a pre-punched sheet, a pre-perforated sheet, a self-adhesive sheet, a sheet having a front side and a back side which have a different media structure like one-sided coated sheets or one-sided colored sheets. A sheet having a side for which it is prohibited to touch a heated fusing device, a heated fixation device, a drying device and/or a UV curing device may also be classified as a speciality sheet.

Opposite edges of such a speciality sheet are unexchangeable and predetermined and should not be changed during the passes in the printing system which is assured by the present invention. The opposite edges may be a leading and trailing edge of the speciality sheet in the feed direction through the paper path or a left and right edge of the speciality sheet in a direction perpendicular to the feed direction.

The described embodiments of the printing system according to the present invention may be varied upon and/or combined according to skills of a skilled person in the art. The described embodiments of the method according to the present invention may be varied upon and/or combined according to the skills of a skilled person in the art. The skilled person will recognize that other embodiments are possible within the scope of the appended claims.

The invention claimed is:

1. A printing system for cut sheets, the printing system comprising a control unit for controlling the printing of image data on a plurality of sheets comprising at least one speciality sheet intended to be one-sided printed and at least one duplex sheet intended to be two-sided printed, and for scheduling the plurality of sheets in a printing order, a paper path comprising a duplex printing loop, a first turn station arranged in the duplex printing loop for turning a sheet of the plurality if both sides of the sheet are scheduled to be printed in two passes along a print engine arranged in the duplex printing loop and configured to dispose marking material on the sheets according to the image data on one side per pass, wherein the speciality sheet has predetermined unexchangeable opposite edges, the control unit comprises a scheduler to schedule a sheet for a first pass along the print engine and for a second pass along the print engine by using the duplex printing loop and a logic module to determine whether or not the sheet is a speciality sheet, the printing system comprises a second turn station arranged in the paper path of the printing system near an inlet of the output section for turning the sheet before laying the sheet off in an output holder of the output section when activated, and the control unit is configured, for a sheet determined not to be a speciality sheet by means of the logic module, to activate the first turn station to turn the sheet after the first pass and before the second pass of the sheet along the print engine, and, for a sheet determined to be a speciality sheet by means of the logic module, to deactivate the first turn station as to behave as a pass-through for the sheet after the first pass and before the second pass of the sheet along the print engine.

2. A printing system according to claim 1, wherein the first turn station and the second turn station are arranged to turn a sheet in a feed direction such that a trailing edge of the sheet becomes a leading edge of the sheet.

3. A printing system according to claim 1, wherein the first turn station and the second turn station are arranged to turn a sheet in a direction perpendicular to the feed direction of sheets through the paper path such that a left edge of the sheet in the non-feed direction becomes a right edge of the sheet in the direction perpendicular to the feed direction.

4. A printing system according to claim 1, wherein the control unit is configured to schedule a simplex sheet intended to be printed on only one side for the first pass and/or for the second pass along the print engine as if the simplex sheet is a speciality sheet.

5. A printing system according to claim 4, wherein the print engine comprises an inkjet print head with a plurality of nozzles and the control unit comprises a spitting scheduler for keeping the plurality of nozzles fit, the spitting scheduler configured to prohibit a spitting action during the second pass along the print engine on a side of the simplex sheet which is intended to be printed upon and on a side of a speciality sheet which is intended to be printed upon.

6. A printing system according to claim 4, wherein the print engine comprises an inkjet print head with a plurality of nozzles and the control unit comprises a spitting scheduler for keeping the plurality of nozzles fit, the spitting scheduler configured to activate a spitting action during the first and the second pass along the print engine on a same side of the simplex sheet which is intended to be printed upon and on a same side of a speciality sheet which is intended to be printed upon.

7. A printing system according to claim 1, wherein the second turn station is part of the output section of the printing system.

8. A printing system according to claim 1, wherein the control unit is configured, for a sheet determined not to be a speciality sheet by means of the logic module, to activate the second turn station after the second pass of the sheet along the print engine and before the sheet is laid off in the output holder, and, for a sheet determined to be a speciality sheet by means of the logic module, to deactivate the second turn station as to behave as a pass-through for the sheet after the second pass of the sheet along the print engine and before the sheet is laid off in the output holder.

9. A printing system according to claim 1, wherein the control unit is configured, for a sheet determined to be a speciality sheet by means of the logic module, to activate the second turn station after the second pass of the sheet along the print engine and before the sheet is laid off in the output holder, and, for a sheet determined not to be a speciality sheet by means of the logic module, to deactivate the second turn station as to behave as a pass-through for the sheet after the second pass of the sheet along the print engine and before the sheet is laid off in the output holder.

10. A method for controlling the printing of image data by means of a printing system on a plurality of cut sheets comprising at least one speciality sheet intended to be one-sided printed and at least one duplex sheet intended to be two-sided printed, and for scheduling the plurality of sheets in a printing order, the printing system comprising a paper path with a duplex printing loop, a first turn station arranged in the duplex printing loop for turning a sheet of the plurality if both sides of the sheet are scheduled to be printed in two passes along a print engine arranged in the duplex printing loop and configured to dispose marking material on the sheets according to the image data on one side per pass, and a second turn station arranged in the paper path of the printing system near an inlet of an output section for turning the sheet before laying the sheet off in an output holder of the output section, wherein the speciality sheet has predetel mined unexchangeable opposite edges, and wherein the method comprises the steps of scheduling a sheet for a first pass along the print engine and for a second pass along the print engine by using the duplex printing loop and determining whether or not the sheet is a speciality sheet, for a sheet determined not to be a speciality sheet, activating the first turn station to turn the sheet after the first pass and before the second pass of the sheet along the print engine, and, for a sheet determined to be a speciality sheet, deactivating the first turn station as to behave as a pass-through for the sheet after the first pass and before the second pass of the sheet along the print engine.

11. A software product comprising program code on a non-transitory computer-readable medium, wherein said program code, when loaded into a computer that is connected to a printing system causes the computer to act according to a method of claim 10.

* * * * *